US007601184B2

(12) United States Patent
Tischendorf

(10) Patent No.: US 7,601,184 B2
(45) Date of Patent: Oct. 13, 2009

(54) METHOD FOR PRODUCING CANDLES CONSISTING OF VEGETABLE OR ANIMAL OILS OR FATS

(76) Inventor: Dieter Tischendorf, Battensteinstrasse 15, Hilders D-36115 (DE)

( * ) Notice: Subject to any disclaimer, the term of this patent is extended or adjusted under 35 U.S.C. 154(b) by 779 days.

(21) Appl. No.: 10/503,593

(22) PCT Filed: Feb. 21, 2003

(86) PCT No.: PCT/EP03/01773

§ 371 (c)(1),
(2), (4) Date: Aug. 13, 2004

(87) PCT Pub. No.: WO03/070865

PCT Pub. Date: Aug. 28, 2003

(65) Prior Publication Data

US 2005/0095545 A1 May 5, 2005

(30) Foreign Application Priority Data

Feb. 21, 2002 (DE) ..... 102 07 258

(51) Int. Cl.
*C11C 5/00* (2006.01)

(52) U.S. Cl. ..... 44/275; 431/288; 264/5; 264/6; 264/13; 264/114

(58) Field of Classification Search ..... 44/275; 431/288; 264/5, 6, 13, 114
See application file for complete search history.

(56) References Cited

U.S. PATENT DOCUMENTS 3,002,221 A * 10/1961 Wright ..... 264/112
3,560,122 A 2/1971 Cassar
3,950,561 A 4/1976 Collins
4,614,625 A * 9/1986 Wilson ..... 264/6
5,171,329 A * 12/1992 Lin ..... 44/275
6,599,334 B1 * 7/2003 Anderson ..... 44/275

FOREIGN PATENT DOCUMENTS

DE 2850353 A1 5/1980
DE 4242509 A1 6/1994
DE 19516244 A1 11/1996
DE 19601521 A1 7/1997

(Continued)

OTHER PUBLICATIONS

Database WPI, Section Cb, Week 200039, Derwent Publications, Ltd., AN 2000-450447, XP002214866 (English Abstract of TW 373,019).

(Continued)

*Primary Examiner*—Cephia D Toomer
(74) *Attorney, Agent, or Firm*—Charles P. Boukus, Jr.

(57) ABSTRACT

The invention relates to a method for producing candles comprised of a starting material that contains, at least in part, fats and/or oils. Optional additives such as colorants are admixed to the starting material, and the starting material, in a liquid phase, is sprayed onto a cooling medium (10) whereby being transformed into a solid phase and, during a pressing process, is subsequently pressed to form a pressed article and is optionally milled. According to the invention, the starting material solely contains oils and/or fats that are hardened and, on the cooling medium (10), are transformed into an essentially homogenous, crystalline, preferably granular crystalline structure.

22 Claims, 1 Drawing Sheet

FOREIGN PATENT DOCUMENTS

Figure 1:
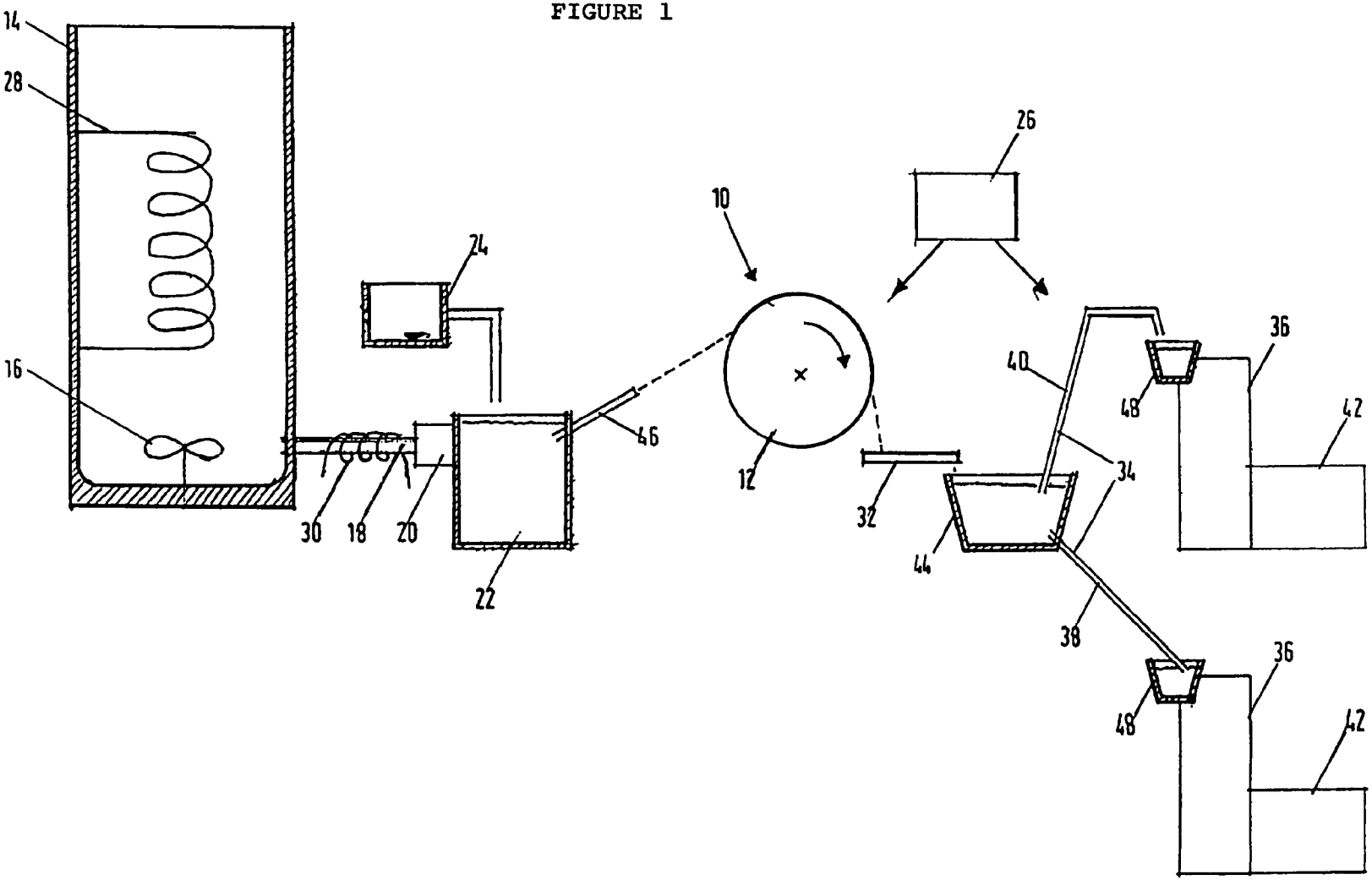

| | | | |
|---|---|---|---|
| EP | 0393963 | A3 | 10/1990 |
| GB | 859771 | | 1/1961 |
| TW | 373019 | | 11/1999 |
| WO | WO 99/27043 | | 6/1999 |
| WO | WO 02/092736 | | 11/2002 |
| WO | WO 03/012016 | | 2/2003 |

OTHER PUBLICATIONS

Fachbuch fur der Wachszieher/Wachsbildner, Bayerische Wachzieherinnung, Copyright 1998 and English translation of excerpts.

"Kerzen", Gutesicherung RAL-GZ 041, Deutsches Institut Fur Gutesicherung Und Kennzeichnung E. V., Mar. 2005.

* cited by examiner

METHOD FOR PRODUCING CANDLES CONSISTING OF VEGETABLE OR ANIMAL OILS OR FATS

The invention relates to a method for producing candles, comprising a starting material which at least in part contains fats and/or oils and to which additives such as colorants are optionally added, the starting material being sprayed in a liquid phase onto a cooling medium, for instance onto a roller cooler or in a spray tower, and converted into a solid phase and then compacted into a pressed part in a pressing process.

Such a method is already known from German Patent Disclosure DE 196 01 521 A1. The starting material contains for instance 50% palm oil and 50% paraffin. In this kind of mixture of the starting material, which then has both fine and granular crystalline structures, the problem arises of demixing of the fine and granular crystalline components during the processing of the starting material. In this respect, it is provided in this prior art that the ingredients be mixed together initially in liquid form and the material then be cooled down with a high temperature gradient, so that demixing of the ingredients no longer occurs; the solidified composition is then processed into candles in the pressing process.

In this prior art, it is also proposed that fatty alcohol be used as the fine crystalline component of the starting material, but then care must be taken to assure the waxlike substance contain at least one ingredient that, below its melting point, has a recognizable softening point. However, the provisions for preventing demixing of the fine and granular crystalline components prove to be complicated. If the proportion of paraffin in the starting material is reduced to values below 50%, there is the problem that the spraying and pressing method for producing candles creates difficulties. For instance, the material adheres superficially to the roller cooler and the adhesions must be removed from the roller by a steel scraper, using high contact pressure. This shortens the service life of both the rollers and the scraper considerably. Moreover, these provisions are disruptive to a smooth course of the process. As the process continues, the scraped-off pieces, in the form of paraffin and fat conglomerates (known as "scraper sausages") drop onto the jigger plate, on which because of their consistency they can be moved along only with difficulty, if at all. In addition, the jigging speed must be increased, so both the jigger plate and the drive mechanism are subjected to increased wear.

Furthermore, there is the problem that the starting material bakes in the collection container for the material, making it virtually impossible to transport it in the vacuum system, since it is more difficult to pick it up from the collection container. In the vacuum segment, the intake pressure must also be increased sharply at room temperature in the range of 20° C., to enable transporting these lumps of paraffin and fat onward to the pressing system. In the pressing system itself, both defective filling of the pressing molds and instances of sticking occur, making uninterrupted operation almost impossible. Down times and repair periods reduce the overall production output, while intervention on the part of machine operators is increased considerably.

Nor does the further course of the production process, leading to the packaging area, always run smoothly, since residues of paraffin and fat repeatedly cause soiling and sticking. Moreover, there is a fundamental need to reduce the proportion of paraffins or other products from the mineral oil industry, on the one hand so as to assure an uninterrupted course of production and on the other to use renewable resources, in particular vegetable fats or oils, or animal fats or oils.

From German Patent Disclosure DE 195 16 244 A1, a fuel for a candle is already known that comprises vegetable oils or fats; to this starting material, flame-retardant substances such as strontium, copper, barium, sodium, or the like are added. For example, the starting material can comprise 80% rapeseed oil and 20% sunflower oil. No information about the process of producing the candles can be learned from this reference; it remains unknown whether the candles are produced by casting, pressing, drawing, or extrusion.

German Patent Disclosure DE 42 42 509 A1 relates to a candle for graves and memorials that comprises a vessel, filled with fuel, with a wick in it. To enable nonpolluting disposal of this kind of candle, it is provided that the vessel comprise a biodegradable material with a flame-retardant additive. The fuel, or the starting material itself, is produced from natural fats and/or oils, and the wick is cotton. For the fuel, a solid body compacted from granulate material is provided, and the granulate may comprise a combination of vegetable and/or animal oils and/or fats, such as fish oil, rapeseed oil, and palm oil. The precise composition should be selected such that the combustion properties are as good as possible, and moreover that the mechanical properties of the granulate, in terms of elasticity and plasticity, are favorable for the ensuing pressing process. From this reference, nothing can be learned about any method for producing the granulate with these properties.

German Published, Examined Patent Disclosure DE-AS 11 91 507 discloses a method for producing oil candles, in which vegetable oils that are subjected to a hardening process and are optionally mixed with other vegetable oils are used as the starting material for the candle. In particular, vegetable oils of which approximately 80% are hardened by hydrogenation and approximately 20% is liquid are used. For example, soy oil, corn oil, peanut oil, cottonseed oil, sesame seed oil, or palm oil is processed for the purpose. This starting material is melted and mixed and then poured by means of a dispensing machine into a container. It is therefore provided that the candle composition is poured, in a first work step, only up to 8/10 or 9/10 of the height of the container, and the remaining candle composition is added after the starting material has solidified.

By comparison, it is the object of the present invention to disclose a method for producing candles or thermal storage material in which it is possible to dispense with the use of paraffins or stearines, and the candles can be produced with a high degree of process safety by the pressing process.

In the method having the characteristics named at the outset, this object is attained essentially in that the starting material contains solely oils and/or fats, and the oils and/or fats are hardened and converted at the cooling medium into an essentially homogeneous, crystalline, preferably granular crystalline structure.

In the method of the invention, no demixing problems arise, because 100% fat or oil is used as the starting material, and the mixture contains only fat or fat mixtures from the same class of substances, in particular refined to various grades and hardened. Moreover, because the starting material contains solely oils and/or fats, and the oils and/or fats are hardened and converted at the cooling medium into an essentially homogeneous, crystalline, preferably granular crystalline structure, it is assured that this starting material can be processed very easily and without problems in the spraying/pressing process, since adhesions to the roller cooler and the occurrence of fat conglomerates or lumps of fat in the later conveyor segments are avoided.

In one feature of the invention, it is advantageously provided that the optionally purified oils and/or fats are refined, preferably in the range from crude to fully refined, and/or are preferably hardened differently, and have an iodine number of approximately <1 to approximately <10. By these provisions, it is assured that specific changes in the starting material are made by suitable refining and hydrogenation, so that the starting material can be converted at the spray roller into a homogeneous, granular crystalline structure and can also be transported afterward without problems via conveyor systems, such as vacuum or gravity systems, and can also be processed into a pressed part in a downstream pressing system.

Advantageously, the melting point of the starting material is in the range from approximately 40° C. to approximately 80° C., preferably in the range between approximately 44° C. and 68° C.

In a further feature of the invention, it is provided that the starting material contains a mixture of substances of a single class of substances, such as oils or fats, thus effectively counteracting later demixing during the production process.

In a further feature of the invention, the starting material is a substance or a mixture of substances that is a vegetable or animal oil or fat, also known as renewable resources, that can be selected from the group comprising soy oil, palm oil, palm kernel fat, rapeseed oil, linseed oil, sunflower oil, thistleseed oil, or similar natural vegetable fats or oils, or animal fats or oils, such as fish oil or the like.

In another advantageous feature of the invention, the starting material is prepared and furnished in such as way that it has a steep melting shoulder.

In another refinement of the invention, it is provided that the starting material is converted by the cooling medium, in particular the roller cooler, into a dry, crystalline structure which is absorbent and compactable.

It is advantageously provided that the starting material is held in or converted to the liquid phase in a heated tank in the temperature range from approximately 65° C. to approximately 85° C. and is optionally recirculated by means of a stirring mechanism and is also delivered, via a preferably heated line, to a premelting basin by means of a metering pump or the like.

Advantageously, in the premelting basin, by means of a dispenser, additives, in particular colorants and/or fats or oils, are added to the starting material. Thus a colorant of for instance palm kernel oil can also be added to the starting material in the liquid phase in the premelting basin in a ratio of 1% to 50%, as a result of which the adhesive power of the later pressed part can be improved.

It is also advantageously provided that the starting material is sprayed from the premelting basin onto the cooling medium, in particular the roller cooler, at overpressure and at a spraying temperature of approximately 64° C. to approximately 80° C.

The cooling medium, in particular the roller cooler, in a further feature of the invention, is advantageously kept by means of a cooling system at a temperature in the range from approximately 4° C. to approximately 12° C.

In another special feature, it is provided that the roller cooler has a rotary speed of approximate 4 to 12 rpm, for a diameter of the roller of approximately 1.5 m.

In a refinement of the invention in this respect, it is provided that the starting material is conveyed from the cooling medium in the crystalline, cold state by means of a jigger plate or similar transporting device to a material collection container and by means of a conveyor system from the collection container to a pressing system.

In one feature, the conveyor system may be embodied as a gravity conveyor; in that case, the pressing system is disposed under the collection container, and the crystalline, cold starting material in granulate form passes from the collection container into the pressing system by gravity.

It is an attractive option to embody the conveyor system alternatively as a vacuum conveyor; in that case, the crystalline, cold starting material in granulate form is conveyed to the pressing system with the aid of partial vacuum.

It is advantageously provided that the vacuum conveyor is operated in a partial vacuum range of from 0.5 bar to 4 bar.

Besides gravity and/or vacuum conveyance, a worm conveyor, for instance in the form of an Archimedes screw, maybe be employed. The pressing system processes the crystalline starting material into pressed parts, preferably at pressures in the range from approximately 80 bar to approximately 150 bar.

It is then recommended that the pressed part have a wick inserted into it, be processed further, and optionally be packaged, or that it be put into the desired form by a milling machine, for instance to produce a taper or a household candle.

The invention also relates to a paraffin- and stearine-free candle, produced by the spray/pressing process, and, in particular in accordance with one of the foregoing claims, comprising a starting material which contains solely vegetable or animal fats or oils and optionally an additive, wherein the candle is embodied as a tea light, burner, votive candle, household candle or taper. The starting material for the candle is produced by one or more of the method steps named above, and the aforementioned renewable animal or vegetable substances may be used, either on their own or in mixture form.

With the method of the invention, stable candle bodies can be produced for any product.

In one feature of the invention, it is advantageously provided that the wick has a very brief afterglow phase and is preferably embodied with from 20 to 24 filaments. As a result of this provision, oxidation products, which in the starting materials described can cause odors to develop, are essentially avoided.

Further characteristics, advantages, possible uses, and features of the present invention will become apparent from the ensuing description of exemplary embodiments in conjunction with the drawings. All the characteristics described and/or shown in the drawing are the subject, either on their own or in arbitrary appropriate combination, of the present invention.

The sole FIGURE of the drawing schematically illustrates an apparatus for performing the method of the invention.

The starting material is converted into the liquid phase in a tank 14 with a heating system 28, or if the material already reaches the tank 14 in liquid form, it is kept there in the liquid phase and optionally mixed using a stirring mechanism. From the tank 14, the starting material is delivered in the liquid phase, via a line 18 that is optionally heated via a heating system 30, to a metering pump 20 and enters a premelting basin 22. By means of a dispenser 24, an additive, such as a colorant or a further oil or fat, can be added to the liquid starting material in the premelting basin 22.

From the premelting basin 22, the starting material, to which additives have optionally been added, is sprayed by a sprayer device onto a cooling medium 10, which in the present exemplary embodiment is embodied as a roller cooler 12. It is understood that the cooling medium 10 may for instance be a spray tower instead.

After the granular crystalline has cooled down and been converted into a homogeneous, granular crystalline state, the solidified starting material is transferred to a collection container by means of a jigger plate 32. From this collection container, the starting material, in the form of a cold, granular crystalline granulate, is conveyed to a pressing system 36 by means of a conveyor system 34.

As shown in the upper part of FIG. 1, the conveyor system 34 may be embodied as a vacuum conveyor 40; in that case, the starting material is conveyed in a vacuum through lines to the pressing system 36. Both the lines of the vacuum conveyor 40 and the cooling medium 11, or roller cooler 12, may be cooled by means of a cooling system 26.

However, it is also possible, as shown in dashed lines in the lower portion of FIG. 1, for the conveyor system 34 to be embodied as a gravity conveyor 38; in that case, the starting material is conveyed from the collection container 44 via a line to the pressing system 36, or to a collection container on the inlet side, by gravity. The pressing system 36 is followed by a wick-inserting device as well as other processing devices, and finally by a packaging system 42.

Examples of starting materials that can be used are homogeneous, high-melting-point, crude-hardened or fully refined fractions of vegetable or animal fats or oils in which the usual melting shoulder is minimized; for instance, from 1 to 10% palm kernel oil can be used, to improve the adhesive power of the pressed part. The melting temperature may be in the range from 42° C. to approximately 72° C. Compared to the use of starting materials containing paraffin or stearine, not only the pressing temperature and pressing pressures but also the operating speed of the press can be varied appropriately. In particular, the pressing dies can also be prepared accordingly, and the threader speed can be adapted during the wick insertion operation. As for the roller cooler, the rpm can be reduced or can remain the same, compared to conventional starting materials.

In another example, rapeseed and palm oils can be used, with a melting point of 44° C. to 68° C., sometimes 80° C., ranging from the crude to the fully refined product with correspondingly various degrees of hardening. The processing of the material is done by way of refining and hydrogenation, until the desired degree of hardness is reached.

If the hydrogenation quality is "crude", an odor problem, especially an odor of fat, arises when it is burned and can be unpleasant if the candle is used in a room. This is avoided especially by using an impregnated wick, with an only brief afterglow phase. Rapeseed oil or palm oil in a ratio of 1% to 50% palm kernel oil can be admixed with the starting material.

The method, in one exemplary embodiment, can be described as follows:

The liquid, hardened, pure fat is transported in the temperature range from approximately 65° C. to approximately 85° C. from the heated tank 14 via heated lines 18 to the premelter 22 by means of a metering pump 20. By means of a dispenser 24, additives such as colors, or other fats, can be added to the starting material.

From the premelter 22, spraying of the starting material onto the roller cooler 12 is done by the sprayer device 46 at various pressures, and the roller cooler is operated at various rotary speeds, at temperatures in the range from approximately 4° C. to approximately 12° C., and optionally also with different diameters.

As a result of cooling down, the starting composition crystallizes coarsely, and demixing problems do not arise since as a rule oils or fats of a single substance class are used.

Via a jigger plate 32, the cold, crystalline starting composition is transported to a collection container 44, from which the starting material is conveyed to a pressing system 36 by means of a conveyor system 34, which may be embodied as either a gravity conveyor 38 or a vacuum conveyor 40. If a vacuum conveyor 40 is used, the crystalline composition is transported to the various presses at a negative pressure of approximately 0.5 bar to approximately 4 bar and collected in a collection container 48 associated with the pressing system 36.

In the pressing system, the pressing tools are varied, for instance by inserting spacer shims from above and/or from below, to assure either the same or modified pressures from above and/or below. By these provisions, overpressure phenomena in the region of the pressed part, which can lead to breakage of the pressed part, can be avoided.

It may also be provided that both the pressing tools and the pressing mold be heated, to improve both the surface finish and the adherence of the pressed part. The pressed part is carried via a rail system to the suitably adapted threader, where it is provided with a wick, and processed further and finally packaged in a packaging system 42.

LIST OF REFERENCE NUMERALS

10 Cooling medium
12 Roller cooler
14 Tank
16 Stirring mechanism
18 Line
20 Metering pump
22 Premelting basin
24 Dispenser
26 Cooling system
28, 30 Heating system
32 Jigger plate
34 Conveyor system
36 Compactor
38 Gravity conveyor
40 Vacuum conveyor
42 Packaging system
44 Collection container
46 Sprayer
48 Collection hopper

The invention claimed is:

1. A method for producing candles, comprising:

providing a liquid phase starting material which is selected from the group consisting of vegetable oils, vegetable fats, animal oils, animal fats, and mixtures thereof, the liquid phase starting material being paraffin-free and stearine-free and having an iodine number in the range of from approximately <1 to approximately <10;

spraying the starting material in liquid phase onto a cooling medium or into a spray tower to convert the starting material into a granulate solid phase which is essentially homogeneous and crystalline; and pressing said granulate solid phase into a compacted form.

2. The method of claim 1, wherein the melting point of the starting material is in the range of from approximately 40° C. to approximately 80° C.

3. The method of claim 1, wherein the starting material contains a mixture of substances of only one class of said oils or said fats.

4. The method of claim 1, wherein the oil or fat of the starting material is selected from the group consisting of soy oil, palm oil, palm kernel fat, rapeseed oil, linseed oil, sunflower oil, thistleseed oil, animal fats and animal oils.

5. The method of claim 1, wherein the starting material has a steep melting shoulder.

6. The method of claim 1, wherein the starting material is converted by the cooling medium into a dry, crystalline structure which is absorbent and compactable.

7. The method of claim 1, wherein the starting material is held in or converted to the liquid phase in a heated tank in the temperature range of from approximately 65° C. to approximately 85° C. and is delivered, via a heated line, to a premelting basin by a pump.

8. The method of claim 7, wherein, in the premelting basin colorants and/or fats or oils, are added to the starting material.

9. The method of claim 7, wherein the starting material is sprayed from the premelting basin onto the cooling medium at a spraying temperature of approximately 64° C. to approximately 80° C.

10. The method of claim 1, wherein the cooling medium has a temperature in the range from approximately 4° C. to approximately 12° C.

11. The method of claim 1, wherein the cooling medium is a roller cooler having a rotary speed of approximately 4 to 12 rpm, and a diameter of approximately 1 m to approximately 2 m.

12. The method of claim 1, wherein the granulate solid phase is conveyed from the cooling medium in a crystalline, cold state, by a transporting device to a conveyor system and from there to a pressing system.

13. The method of claim 12, wherein the conveyor system is a gravity conveyor.

14. The method of claim 12, wherein the conveyor system is a vacuum conveyor.

15. The method of claim 14, wherein the vacuum conveyor conveys the granulate solid phase to the pressing system at a negative pressure of 0.5 bar to 4 bar.

16. The method of claim 12, wherein the conveyor system is a worm conveyor.

17. The method of claim 12, wherein the pressing is at pressures of approximately 80 bar to approximately 150 bar.

18. The method of claim 1, further comprising inserting a wick.

19. A method for producing candles comprising:

providing a liquid phase starting material containing at least one of vegetable oils, vegetable fats, animal oils and animal fats, the liquid phase starting material having an iodine number in the range of approximately <1 to approximately <10;

spraying the starting material in liquid phase onto a cooling medium or into a spray tower to convert the starting material into a granulate solid phase which is essentially homogeneous and crystalline; and pressing said granulate solid phase into a compacted form.

20. The method of claim 19, wherein the starting material contains a mixture of substances of only one class of said oils or said fats.

21. The method of claim 19, wherein the starting material additionally contains a colorant.

22. The method of claim 19, wherein the starting material is paraffin-free and stearine-free.

* * * * *